United States Patent [19]

Preston

[11] Patent Number: 4,773,506

[45] Date of Patent: Sep. 27, 1988

[54] SCAFFOLDING MODULE AND METHOD OF ERECTING SAME

[76] Inventor: John C. Preston, 12 Wentworth Rd., Eastwood, N.S.W., Australia, 2122

[21] Appl. No.: 879,228

[22] PCT Filed: Sep. 19, 1985

[86] PCT No.: PCT/AU85/00229

§ 371 Date: May 9, 1986

§ 102(e) Date: May 9, 1986

[87] PCT Pub. No.: WO86/01847

PCT Pub. Date: Mar. 27, 1986

[30] Foreign Application Priority Data

Sep. 20, 1984 [AU] Australia ..... PG7222
Mar. 6, 1985 [AU] Australia ..... PG9585

[51] Int. Cl.[4] ..... E04G 1/34

[52] U.S. Cl. ..... 182/152; 182/112; 182/178

[58] Field of Search ..... 182/152, 178, 179, 113, 182/47, 131, 112, 159, 156

[56] References Cited

U.S. PATENT DOCUMENTS

| | | | |
|---|---|---|---|
| 1,284,078 | 11/1918 | Evans | 182/152 |
| 3,186,512 | 6/1965 | Johnson | 182/152 |
| 3,221,837 | 12/1965 | Fisher | 182/115 |
| 3,266,208 | 8/1966 | Maggs | 182/179 |
| 3,301,348 | 1/1967 | Hiyama | 182/131 |
| 3,454,131 | 7/1969 | Johnson | 182/178 |
| 3,463,265 | 8/1969 | Clover | 182/152 |
| 3,707,304 | 12/1972 | Gostling | 182/178 |
| 4,017,932 | 3/1977 | Lotto | 182/152 |
| 4,129,197 | 12/1978 | Preston | 182/112 |

FOREIGN PATENT DOCUMENTS

| | | |
|---|---|---|
| 1268388 | 6/1961 | France . |
| 1489411 | 10/1977 | United Kingdom . |
| 2009830 | 6/1979 | United Kingdom . |
| 1600019 | 10/1981 | United Kingdom . |

*Primary Examiner*—Reinaldo P. Machado
*Attorney, Agent, or Firm*—Townsend & Townsend

[57] ABSTRACT

Scaffolding module comprising one or more substantially planar frames (3, 15) to receive building materials: each frame (3, 15) is supported in use in a substantially horizontal position by four substantially parallel support members (2) and each frame (3, 15) and the support members (2) are pivotable relative to each other. Hence, the module (1) can be folded between a reduced volume storage configuration in which each frame (3, 15) lies alongside the support members (2) and an operational configuration in which each frame (3, 15) extends substantially perpendicularly to the support members (2). A method of erecting scaffolding using the described modules is also disclosed.

8 Claims, 5 Drawing Sheets

SCAFFOLDING MODULE AND METHOD OF ERECTING SAME

TECHNICAL FIELD

The present invention relates to scaffolding including a scaffolding module, and to a method of erecting scaffolding using the module. It is to be understood that references herein to scaffolding and erection thereof also includes a reference to formwork for concrete and erection thereof.

BACKGROUND ART

There are many systems of scaffolding available for use by the construction industry and all of them use the same basic components to erect the scaffolding. These basic components, namely standards, ledgers, transoms, platform boards, adjustable screwbases and braces, are required in great numbers and are interconnected with one another to achieve the desired height and configuration necessary for a particular application. The erection procedure using these individual components usually demands that one level of scaffolding be completed at a time and then each subsequent level is built upon the previous one. Similarly, it is conventional when disassembling scaffolding to remove the individual components in reverse order to that used during the erection procedure.

Clearly, the known scaffolding systems require considerable time and manpower to erect or take down which causes significant cost to be incurred and delays commencement of work.

It is also readily apparent that because there are so many individual components required in such scaffolding systems it is extremely easy for parts to be misplaced which necessarily incurs significant replacement costs and can lead to delays in the erection procedure. Additionally, during both erection and disassembly it is extremely inconvenient, particularly at great heights, for workmen to handle and remove the individual components from the scaffolding. Accordingly, there is a great tendency to allow components to drop or fall, especially when sections are being dismantled since this is quicker than lowering them. These actions can create serious accidents and damage to the individual components, both of which lead to additional costs being potentially incurred.

Moreover, the transportation, sorting and storage of large volumes of individual components adds even further to loss of time and manpower, as well as loss of storage space and general inconvenience.

It is the object of the present invention to provide a scaffolding module and a method of scaffolding which will overcome, or substantially ameliorate, the above-mentioned disadvantages.

DISCLOSURE OF THE INVENTION

According to one aspect of the present invention there is disclosed a scaffolding module comprising at least one substantially planar frame to receive building materials and bear the weight of workmen; said frame being supported, in use, in a substantially horizontal position by a plurality of substantially parallel support members; wherein said frame and support members are pivotable relative to each other to permit said module to be folded between a reduced volume storage configuration in which said frame lies alongside said support members and an operational configuration in which said frame extends substantially perpendicularly to said support members.

Preferably, the frame comprises a portion of a substantially planar platform. In some preferred instances, the planar platform is releasably engageable with the frame.

As well, it is preferable that the upper and lower ends of the support members are adapted to releasably engage the lower and upper ends respectively of corresponding support members of like modules positioned above and below the module in a stack of like modules.

It is also preferable that attachment means be provided to secure each module (possibly within a stack), in use, to like modules (possibly within an adjacent stack) positioned adjacent thereto.

Further, it is preferable that, in use, a shield be located in a substantially vertical position on the side of the platform remote from the workface to prevent objects falling from the platform and out of the module.

In addition, it is also preferable, where a module is to be used as a street hoarding which provides a pedestrian thoroughfare with overhead protection around urban construction sites, that appropriate counterweighting and bracing of the module be provided to ensure stability thereof and safety therefrom for the public.

According to another aspect of the present invention there is disclosed a method of erecting scaffolding using the above described modules, said method comprising the steps of unfolding said module from the reduced volume storage configuration, securing said platform in the operational configuration, and, if necessary, subsequently raising said module into its final upright position.

BRIEF DESCRIPTION OF THE DRAWINGS

Some embodiments of the present invention will now be described with reference to the drawings in which.

BEST MODE OF CARRYING OUT THE INVENTION

Figure 1:
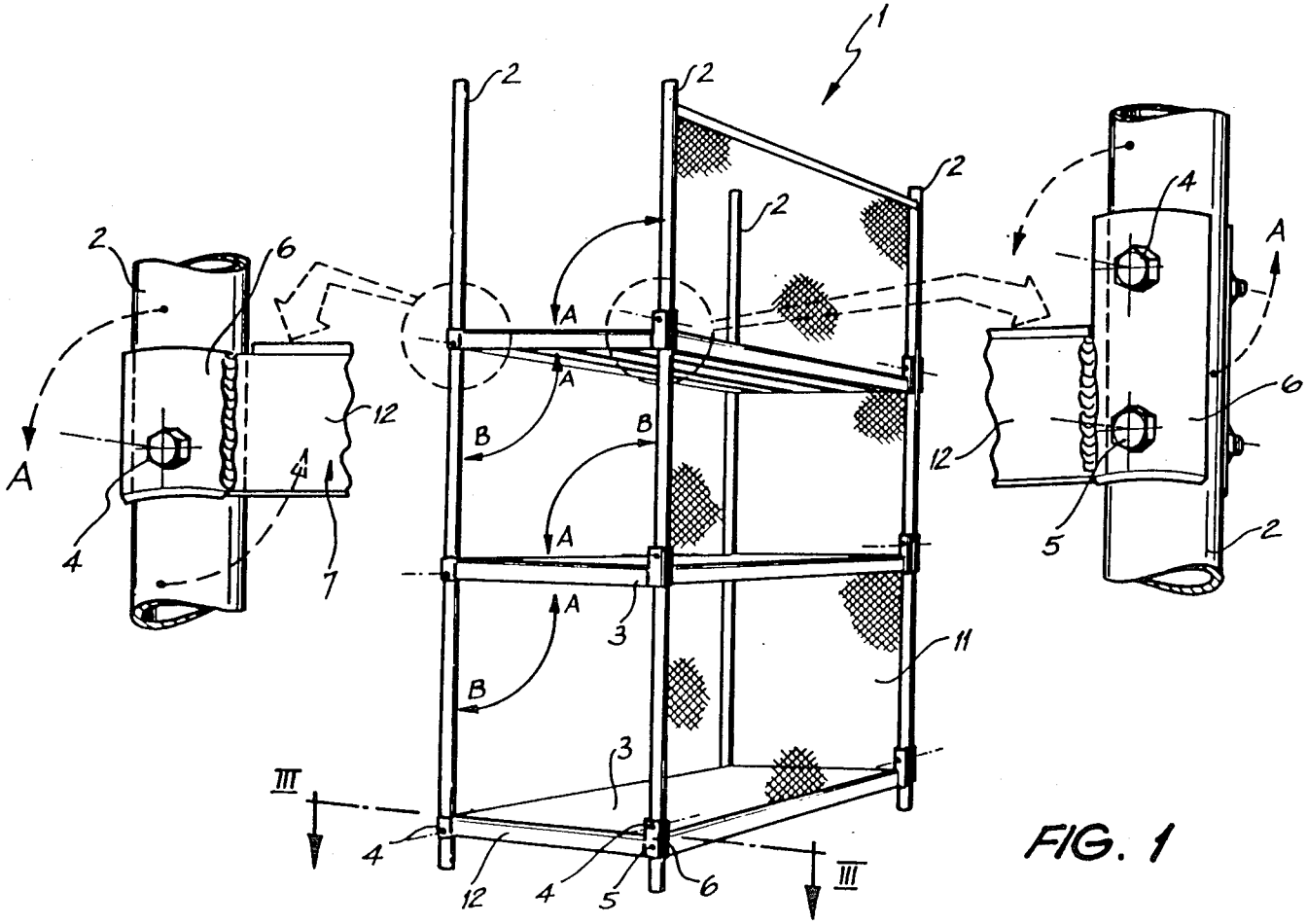
FIG. 1 is a perspective view of the module of a first embodiment in the operational configuration including two detailed views.

As illustrated in FIG. 1, the preferred embodiment of the scaffolding module 1 includes four substantially vertical support members 2 on which are pivotally mounted three substantially horizontal platforms 3. Each of said platforms 3 is pivoted by link bolts 4 to each of the support members 2 and is retained in the operational configuration by securing bolts 5 which pass through both plates 6 and support members 2.

Figure 4:
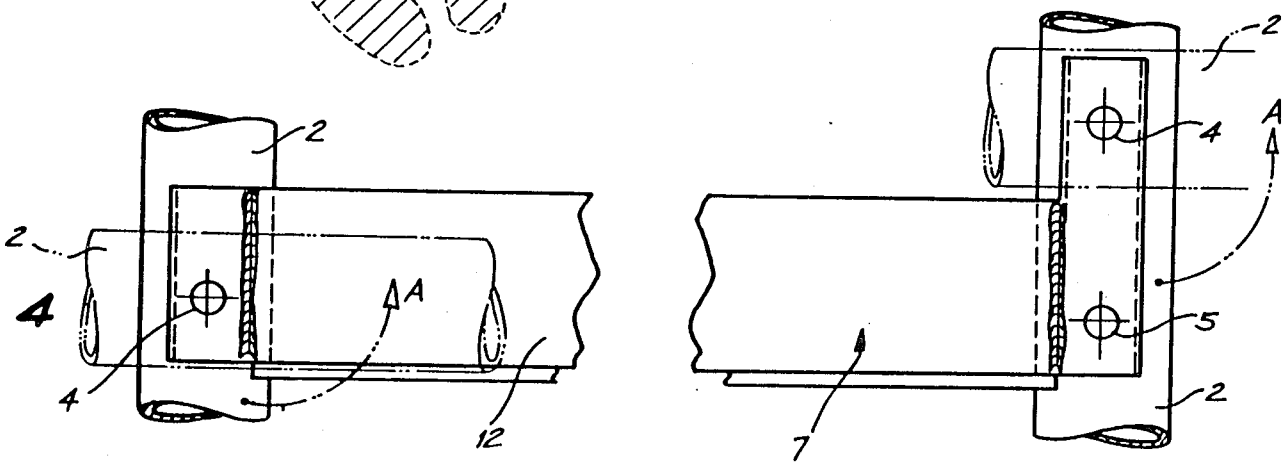
FIG. 4 is a side elevation in the direction of arrow IV of FIG. 3.

As can be best seen in the two detailed views of FIG. 1 and FIG. 4, when the securing bolts 5 are removed, the support members 2 are able to pivot in the direction of arrow A and thus brought into proximity with both one another and the platforms 3. In this way a reduced volume storage configuration (FIG. 2*a*) is achieved, with the module 1 being foldable from the operational configuration illustrated in FIG. 1 into the storage configuration of FIG. 2*a*.

As indicated in FIG. 4, by dashed lines, in the storage configuration, the support members 2 are received by recesses 7 formed in the side ends 12 of platforms 3.

Figure 2D:
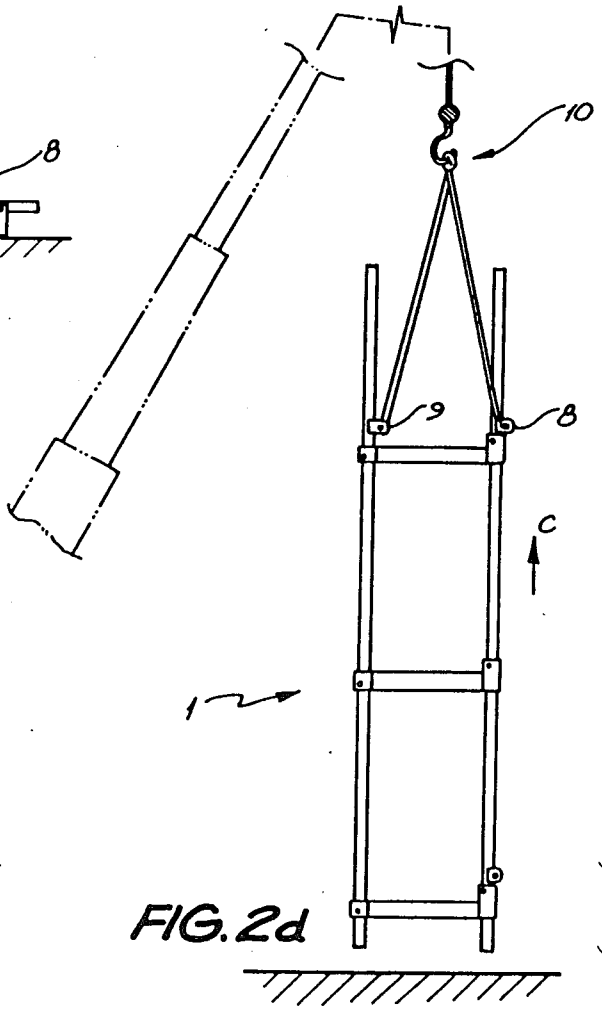
FIG. 2*d* is a side elevation of the module of FIG. 1 being raised.
Figure 2A:
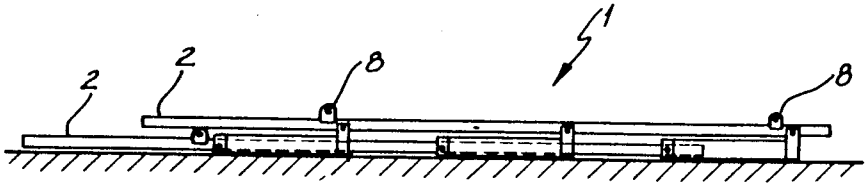
FIG. 2*a* is a side elevation of the module of FIG. 1 in the reduced volume configuration.
Figure 2B:
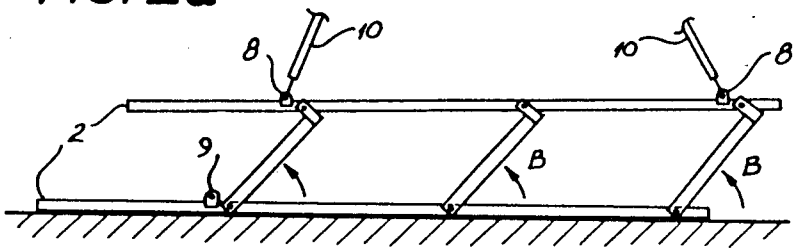
FIG. 2*b* is a side elevation of the module of FIG. 1 in a partially reduced volume configuration.
Figure 2C:
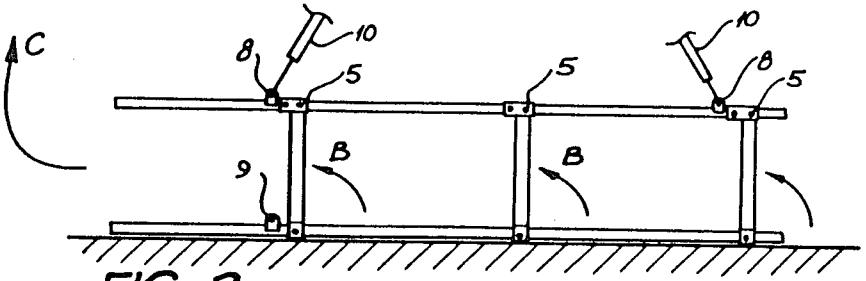
FIG. 2*c* is a side elevation of the module of FIG. 1 in the operational configuration but unraised.

Turning now to FIGS. 2*a*, 2*b*, 2*c* and 2*d*, a module 1 can be raised from the reduced volume storage configuration, by pivoting the platforms 3 in the direction of arrows B by the action of a crane sling 10 which releasably engages lugs 8 attached to the upper pair of support members 2 (FIGS. 2*b* and 2*c*).

To retain the module 1 in the operational configuration, securing bolts 5 are inserted through plates 6 and support members 2 (FIGS. 2*c* and 2*d*). Thereafter, the sling 10 can then releasably engage lugs 9 on the lower pair of support members 2 and one of the lugs 8 in close proximity thereto. Then, the whole module 1 is lifted in the direction of arrow C so as to be both upright and positioned in a predetermined location. In this regard, it is noted that the ends of support members 2 are adapted to releasably engage and releasably receive the ends of support members 2 of like modules positioned above and below the module 1 in a stack of similar modules 1.

With regard to FIG. 2d, it is noted that once a module 1 in the operational configuration is upright and has been located in the predetermined position, it can be further secured by passing a link (not illustrated) between the lugs 8 of adjacent modules 1.

Figure 3:
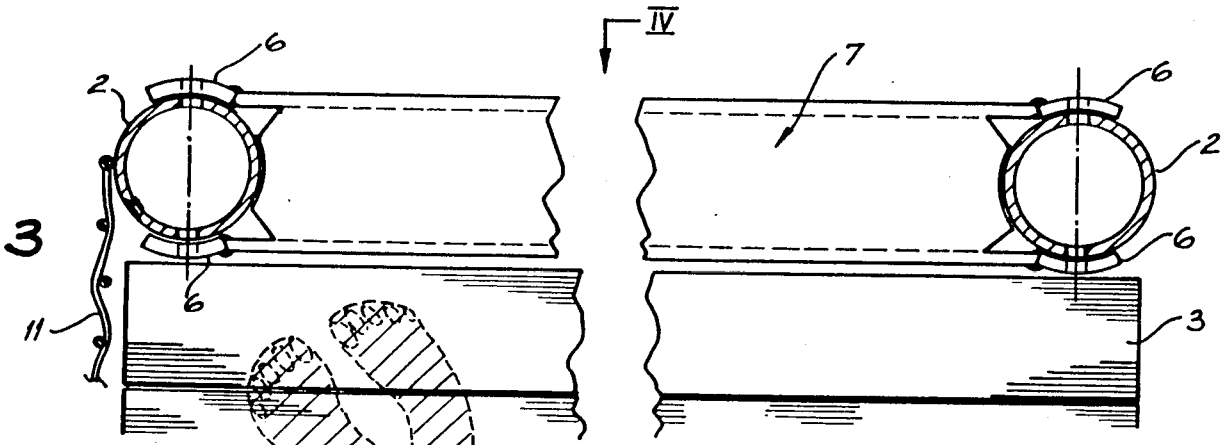
FIG. 3 is a cross sectional view in the direction III—III of FIG. 1.

It will be seen from FIG. 3 that the plates 6 are curved to match the curvature of the support members 2 and this ensures that when the securing bolts 5 are inserted through both plates 6 and support members 2, that the abutment between the surfaces of the support member 2 and the plate 6 is tight, stable and non-slipping.

It will also be seen that a wire mesh 11 (FIGS. 1 and 3) is located between the pair of support members 2 remote from the workface. The mesh 11 extends over substantially the whole length of that face of the module 1 between the pair of support members 2 to ensure that bricks, tools and even workmen do not fall out of the module 1 to the ground below.

Figure 5:
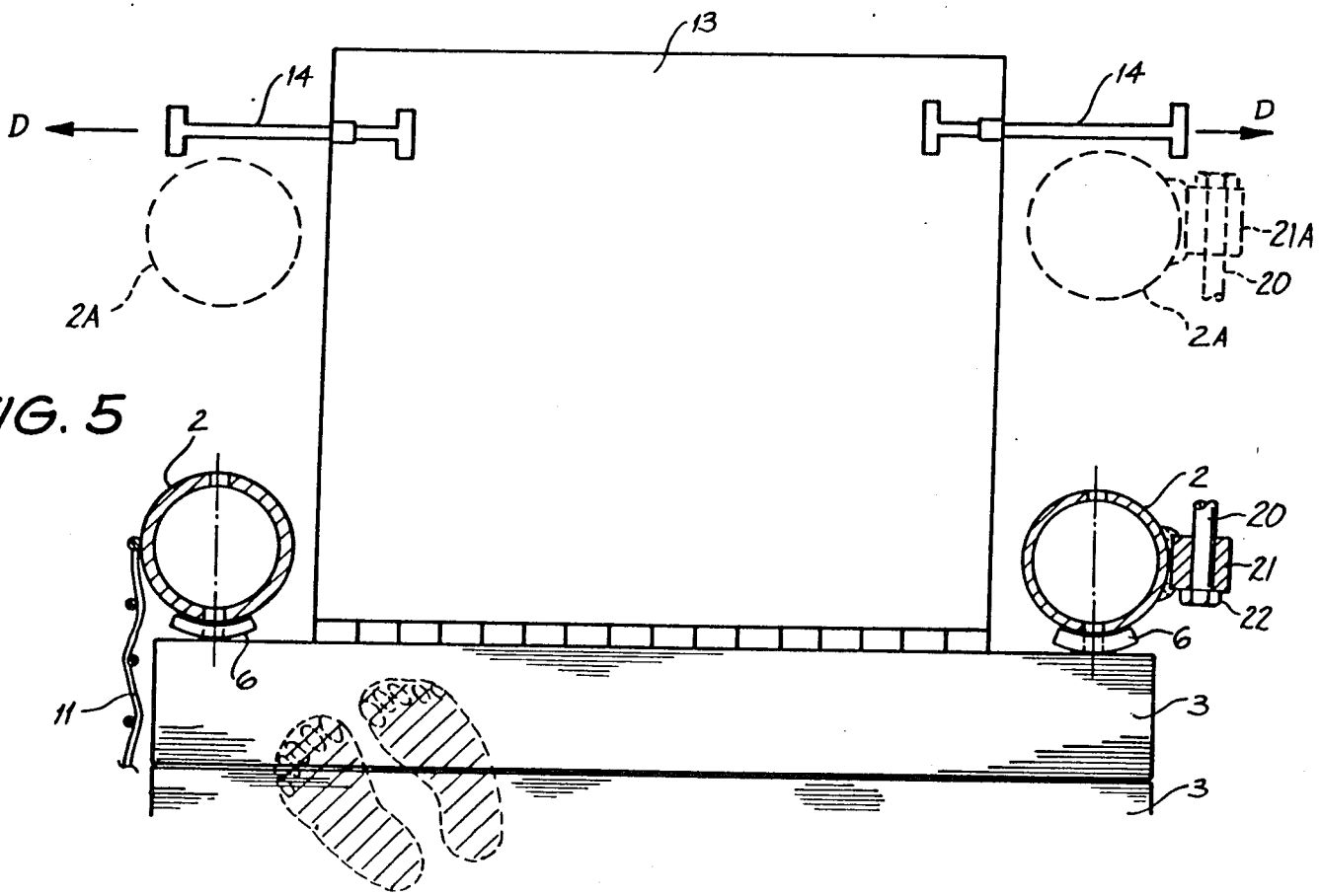
FIG. 5 is a cross sectional view similar to that of FIG. 3, but in respect of the module of a second embodiment.

With reference to FIG. 5, the plate 6, support members 2, wire mesh 11 and platforms 3 are substantially as described above in relation to FIG. 3. However, a single plate 6 is located between the support member 2 and platform 3 which eliminates the need for the recesses 7 (FIG. 3) and an extra external plate 6 (FIG. 3). This, obviously, leaves a gap between co-planar platforms 3 of adjacent like modules 1 but a hinged flap 13 is attached to one end of each platform 3 so that, in use, the flap can be moved from a position adjacent to the platform it is attached to and brought into contact with the platform of the adjacent module. Thereafter, a pair of spring steel slides 14 can be fixedly located around the sides of the pair of support members 2A (illustrated in phantom) adjacent to the side of the first module by outward slide action (Arrow D).

In this embodiment adjacent vertical support members 2, 2A of adjacent modules are fitted with eyelets 21, 21A. A bolt 20 extends through the eyelets, is secured thereto with nuts 22 and defines a securing link between the two adjacent support members.

The securing link can also be formed by hinged plate 13 and slides 14. When adjacent modules are placed side by side, plate 13, being pivotally attached to one of the modules, is pivoted to a position extending between the adjacent modules. Thereafter the slide 14 is positioned by the vertical support members 2A of the adjacent module. This forms a securing link which prevents relative movement between the two adjacent modules.

Figure 6:
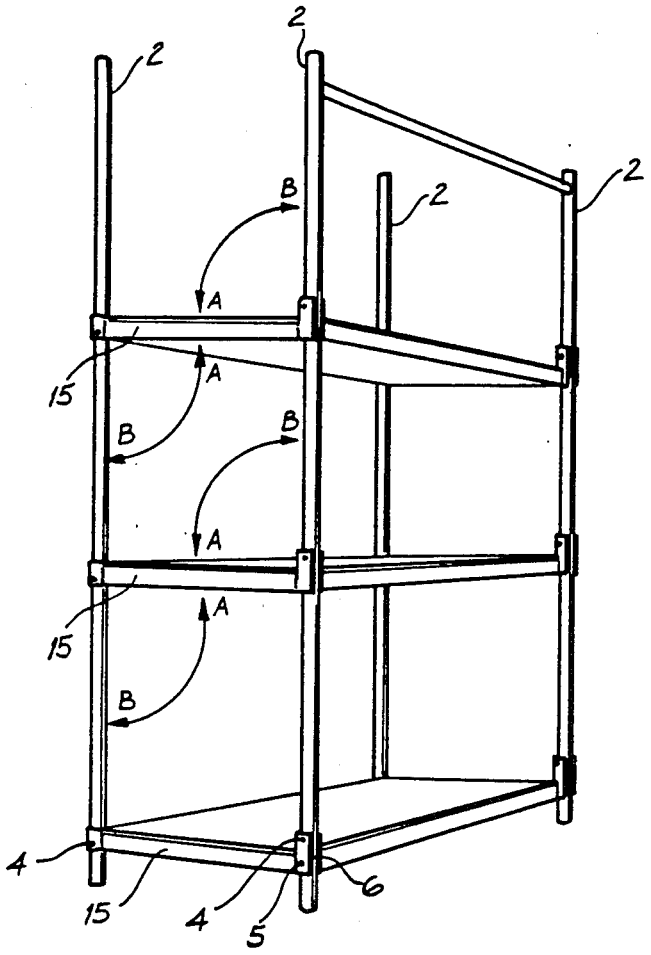
FIG. 6 is a perspective view of the module of a third embodiment in the operational configuration.

Turning now to FIG. 6, the module 1, support members 2, link bolts 4, securing bolts 5 and plates 6 are substantially as described above in relation to FIG. 1. However, as the module 1 is intended for use with concrete formwork (not illustrated) there is no wire mesh 11 (FIG. 1) present and three substantially horizontal frames 15 are pivotally mounted on the support members 2. If desired, the space defined by each frame 15 can be covered by a corresponding removable surface panel 16.

The foregoing describes only one embodiment of the present invention and modifications, obvious to those skilled in the art, can be made thereto without departing from the scope of the present invention. For example, a multi-component scaffolding kit can be utilized to obtain the substantial advantage of the invention. In this regard, individual components are assembled so as to create the module 1 in the reduced volume storage configuration (FIG. 2*a*) or a similar configuration thereabouts prior to raising of the module 1 into the operational configuration (FIG. 1).

I claim:

1. A scaffolding module comprising at least one substantially planar frame adapted to receive building materials and bear the weight of workmen; said frame being supported, in use, in a substantially horizontal position by four substantially vertical support members; means permitting relative pivotal movement between said frame and support members to permit said module to be folded between a reduced volume storage configuration in which said frame lies alongside said support members and an operational configuration in which said frame extends substantially perpendicularly to said support members, and attachment means adapted to releasably engage a pair of said modules in side by side relationship comprising at least one pair of lugs, each one of said lugs having a bore therein, and being located on each one of said support members of said pair being positioned in an adjacent module, and a releasably engageable securing link adapted to pass through said bore and thereby secure each of said pair of lugs.

2. A scaffolding module comprising at least one substantially planar frame adapted to receive building materials and bear the weight of workman; said frame being supported, in use, in a substantially horizontal position by four substantially vertical support members; means permitting relative pivotal movement between said frame and support members to permit said module to be folded between a reduced volume storage configuration in which said frame lies alongside said support members and an operational configuration in which said frame extends substantially perpendicularly to said support members;

a bridging means between each adjacent pair of modules, said bridging means comprising a connector hingedly attached to a first module at one end to a side wall of said frame between a pair of adjacent support members; said connector being foldable between a storage position in which said connector substantially abuts against an uppermost surface of said frame of said first module and a use position in which said connector substantially abuts against an uppermost surface of said frame of a like second module positioned adjacent thereto, said connector including at least one releasably engageable locking means attached to the free end of said connector which, in use, retains said connector in said use position by engagement with at least one said support member of said adjacent like module closest to said module, said locking means comprising a spring steel slide which has an engagement portion which is slidable between a non-use position substantially adjacent to said connector and a use position in which said engagement portion is substantially adjacent said support member.

3. A stackable scaffolding module having four elongated vertical support members which are generally parallel and co-extensive;

at least two work platforms supported by the support members at vertically spaced locations, said platforms being supported by the support members at vertically spaced locations, of generally rectangular configuration and parallel to each other, means pivotally attaching each platform to the support members so that each support member is located adjacent a respective one of the corners of each platform and permitting relative pivotting movement between each platform and the support members about two parallel axes extending generally parallel to longer sides of the platforms and being spaced vertically from each other and from the platforms; and releasable securing means for preventing pivotting of the platforms relative to the support members so that the module is foldable between an erect configuration with the platforms normal to the support members when the securing means is engaged and a folded configuration with the support members pivotted relative to the platforms so the support members are located adjacent each other when the securing means is released to thereby reduce the overall space occupied by the module to facilitate storage and transportation of the module.

4. The module of claim 3 wherein each platform includes four side members and a generally planar sheet member attached thereto.

5. The module of claim 3 wherein said pivot means and said securing means are defined by co-operating clamp members disposed about and in engagement with the associated support means and a tensioning member extending between cooperating clamp members, the tensioning member defining the pivot of pivot means and upon tensioning moving the clamp members towards the the associated support member.

6. A stackable scaffolding module having four elongated vertical support members which are generally parallel and co-extensive;

at least two work platforms supported by the support members at vertically spaced locations, said platforms being generally rectangular in configuration and parallel, each support member being located adjacent a respective one of the corners of each platform;

pivot means attaching each support member to each platform permitting relative pivotting movement between each platform and the support members about two parallel axes extending parallel to longer sides of the platform; and releasable securing means to prevent pivotting of the platforms relative to the support members, said securing means including at least one pair of co-operating clamp members fixed to one platform and being located on opposite sides of one support member and means for securing the clamp member into clamping engagement with the support member to prevent pivotting movement between the platforms and the support members, said clamp members having opposing concave surfaces which co-operate with the associated support member to securely engage the support member to prevent relative movement there between, the securing means being releasable by operating the securing means to allow pivotting of the platforms relative to the support members so that the module is foldable between an erect configuration with the platforms normal to the support members, and a folded configuration with the support members pivotted relative to the platforms so as to be located adjacent each other to thereby reduce the overall space occupied by the module to facilitate storage and transportation purposes.

7. The module of claim 6 wherein at one axes in respect of each platform is spaced vertically from the associated platform.

8. The module of claim 3 or 6, further including means to secure horizontally adjacent modules together to provide a rigid scaffold assembly.

* * * * *